US010946940B1

(12) United States Patent
Lin

(10) Patent No.: US 10,946,940 B1
(45) Date of Patent: Mar. 16, 2021

(54) SMALL SHIP

(71) Applicant: Fujian Doofar Outdoor Sporting Goods Co., Ltd, Longyan (CN)

(72) Inventor: Xi Zhen Lin, Xiamen (CN)

(73) Assignee: FUJIAN DOOFAR OUTDOOR SPORTING GOODS CO., LTD, Longyan (CN)

( * ) Notice: Subject to any disclaimer, the term of this patent is extended or adjusted under 35 U.S.C. 154(b) by 0 days.

(21) Appl. No.: 17/036,021

(22) Filed: Sep. 29, 2020

(30) Foreign Application Priority Data

Sep. 15, 2020 (CN) ..... 202010967141.6

(51) Int. Cl.
*B63B 7/04* (2020.01)
*B63B 34/23* (2020.01)
*B63B 34/21* (2020.01)

(52) U.S. Cl.
CPC ..... *B63B 34/23* (2020.02); *B63B 7/04* (2013.01); *B63B 34/21* (2020.02)

(58) Field of Classification Search
CPC ..... B63B 34/00; B63B 34/20; B63B 34/21; B63B 34/23; B63B 7/00; B63B 7/02; B63B 7/04
USPC ..... 114/343, 352, 354, 355, 357
See application file for complete search history.

(56) References Cited

U.S. PATENT DOCUMENTS 4,800,832 A * 1/1989 Sulimierski ..... B63B 7/04 114/344
8,327,792 B2 * 12/2012 Ohman ..... B63B 34/23 114/347
9,573,658 B2 * 2/2017 Murray, III ..... B63B 3/08
9,708,041 B2 * 7/2017 Ohman ..... B29C 49/48
10,172,438 B2 * 1/2019 Smith ..... A45F 4/10
2014/0318435 A1 * 10/2014 Murray, III ..... B63B 34/20 114/77 R
2015/0053129 A1 * 2/2015 Ohman ..... B63B 34/20 114/347
2016/0194061 A1 * 7/2016 Ohman ..... B63B 7/04 114/347
2017/0106944 A1 * 4/2017 Smith ..... A45F 4/10

* cited by examiner

*Primary Examiner* — Daniel V Venne
(74) *Attorney, Agent, or Firm* — Bayramoglu Law Offices LLC

(57) ABSTRACT

A ship including at least two hull sections spliced together along the axial direction of the ship. The two adjacent hull sections are connected through a splicing structure. The splicing structure includes a first matching structure and a second matching structure. The first matching structure includes a protrusion and a groove that are in a vertical inserting fit. The second matching structure includes a fixed base and a rotating base for rotating to press the fixed base. The hull sections of the present invention are stable to connect and convenient to disassemble and assemble.

17 Claims, 8 Drawing Sheets

SMALL SHIP

CROSS REFERENCE TO THE RELATED APPLICATIONS

This application is based upon and claims priority to Chinese Patent Application No. 202010967141.6, filed on Sep. 15, 2020 the entire contents of which are incorporated herein by reference.

TECHNICAL FIELD

The present invention relates to the field of ships, in particular to a ship.

BACKGROUND

Presently, many ships have a hull that can be split into multiple sections for storage and transportation purposes. However, the multi-section splicing structure is complicated, and the disassembly and assembly are laborious and cumbersome.

SUMMARY

The present invention aims to provide a ship that is convenient to disassemble and assemble. To achieve the foregoing objective, the present invention provides the following technical solution.

A ship that includes at least two hull sections that are spliced together along the axial direction of the ship. The two adjacent hull sections are connected through a splicing structure. The splicing structure includes a first matching structure and a second matching structure; the first matching structure includes a protrusion and a groove that are in a vertical inserting fit; the protrusion and the groove are respectively provided on the two adjacent hull sections; the second matching structure includes a fixed base and a rotating base detachably connected to the fixed base; the fixed base and the rotating base are respectively fitted on the two adjacent hull sections; and the rotating base is configured to rotate; the fixed base is provided with a fixed block; the rotating base is provided thereon with a rotating block that rotates to press a top surface of the fixed block; and the rotating block is clamped with the fixed block.

A side wall of the fixed block of the fixed base is provided with an arc-shaped connecting surface; the arc-shaped connecting surface is provided with external teeth; the rotating block is provided with an arc-shaped elastic piece; an inner side of the arc-shaped elastic piece is provided with internal teeth that are configured to be engaged with the external teeth.

The top surface of the fixed block is provided with a multi-step ladder; the multi-step ladder includes multiple steps in an ascending order of height; the rotating block of the rotating base rotates to press down the steps.

The top surface of the fixed block is provided with an inclined wedge surface; the rotating block of the rotating base is provided with an inclined surface for rotating to press against the wedge surface.

The second matching structure further includes a connecting base rotatably connected with the rotating base; the fixed base and the connecting base of the second matching structure are respectively fixed on the two adjacent hull sections.

There are two second matching structures of the splicing structure, and the two second matching structures of the splicing structure are respectively located on both sides of the ship.

The splicing structure further includes a third matching structure; the third matching structure includes an insert block and a slot that are in a vertical inserting fit; the insert block and the slot are respectively provided on the two adjacent hull sections; the first matching structure and the third matching structure of the splicing structure are staggered along the axial direction of the ship.

The first matching structure and the third matching structure of the splicing structure are staggered in a vertical direction; a corner of the insert block of the third matching structure is chamfered or right-angled.

The protruding direction of the protrusion of the first matching structure of the splicing structure is opposite to the protruding direction of the insert block of the third matching structure.

The splicing structure further includes a first matching surface and a second matching surface that are respectively provided on two adjacent hull sections; the first matching surface and the second matching surface are positioned opposite to each other; the first matching surface is provided thereon with a protruding first matching section, and the second matching surface is provided thereon with a protruding second matching section; an end surface of the first matching section facing the second matching surface abuts against the second matching surface to form a surface-to-surface contact, and an end surface of the second matching section facing the first matching surface abuts against the first matching surface in a surface-to-surface contact; the protrusion and the groove of the first matching structure are respectively provided on the first matching section and the second matching section; alternatively, the protrusion and the groove of the first matching structure are respectively provided on the second matching section and the first matching section.

The first matching section of the splicing structure is provided with a matching notch; an upper part of the matching notch and a side part of the matching notch that faces the second matching section are open; the second matching section of the splicing structure is provided with a matching protrusion configured to match with the matching notch and is placed in the matching notch; the protrusion and the groove of the first matching structure are respectively provided at the bottom of the matching notch and the bottom of the matching protrusion; the protrusion protrudes upward, and the groove is opened downward; a corner of the protrusion of the first matching structure is chamfered or right-angled.

A handle is provided on the hull section.

By adopting the above solution, the present invention has the following characteristics.

1. The ship is convenient to disassemble and assemble. When there is a need to connect the two adjacent hull sections, the hull sections are configured to be moved first so that a groove and a protrusion on the adjacent hull sections are in a vertical inserting fit. Then, a rotating base is rotated so that a rotating block of the rotating base presses the fixed block of the fixed base and the rotating block is engaged with the fixed block to restrict the protrusion from falling out of the groove. In this way, the adjacent hull sections are connected. When there is an need to split the two adjacent hull sections, the rotating base is first rotated to separate it from the fixed base, and then the hull sections are moved so that the groove, and the protrusion on the adjacent hull sections are separated. In this way, the two adjacent hull sections are separated.

2. The adjacent hull sections of the present invention are connected through a splicing structure, which makes the connection more stable and enables the ship to be carried easily.

3. In the present invention, a corner of the protrusion of the first matching structure is chamfered or right-angled. When the corner of the protrusion is chamfered, it is convenient for the insertion of the protrusion into the groove. When the corner of the protrusion is right-angled, it is possible to fit the protrusion with the groove tightly to improve the connection stability of the first matching structure.

4. In the present invention, the corner of the insert block of a third matching structure is chamfered or right-angled. When the corner of the insert block is chamfered, it is convenient for the insertion of the insert block into a slot. When the corner of the insert block is right-angled, it is possible to fit the insert block with the slot tightly to improve the connection stability of the third matching structure.

Figure 1:
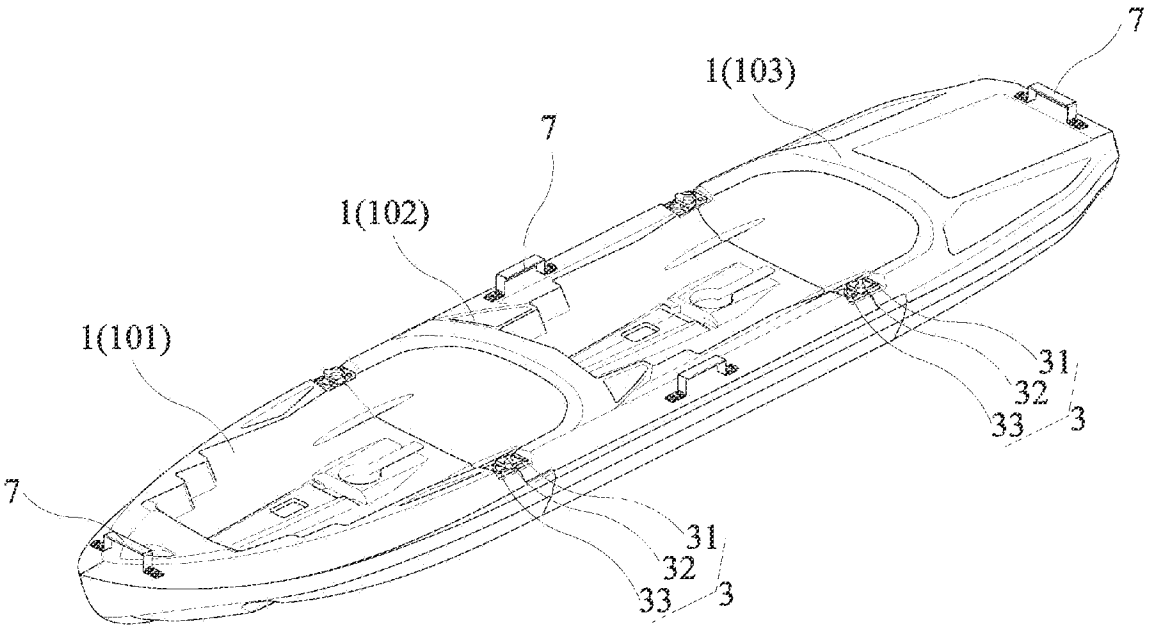
FIG. 1 is a structural view of the present invention.

Reference Numerals:1. hull section; 101. bow section; 102. middle hull section; 103. stern section; 2. first matching structure; 21. protrusion; 22. groove; 3. second matching structure; 31. fixed base; 311. fixed block; 3111. arc-shaped connecting surface; 3112. external tooth; 312. multi-step ladder; 3121. step; 32. rotating base; 321. rotating block; 3211. arc-shaped elastic piece; 3212. internal tooth; 322. shifting block; 4. first matching surface; 41. first matching section; 411. matching notch; 5. second matching surface; 51. second matching section; 511. matching protrusion; 6. third matching structure; 61. insert block; 62. slot; 7. handle.

DETAILED DESCRIPTION

The technical solution of the present invention is described in further detail below with reference to the specific examples of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further medications in the described embodiments and any further modifications in the described embodiments and any further applications of the principles of the invention as described herein are contemplated as would normally occur to one skilled in the art to which the invention relates.

As shown in FIGS. 1-11, the present invention discloses a ship. The ship includes at least two hull sections 1 spliced together along the axial direction of the ship. The two adjacent hull sections 1 are connected through a splicing structure.

Figure 2:
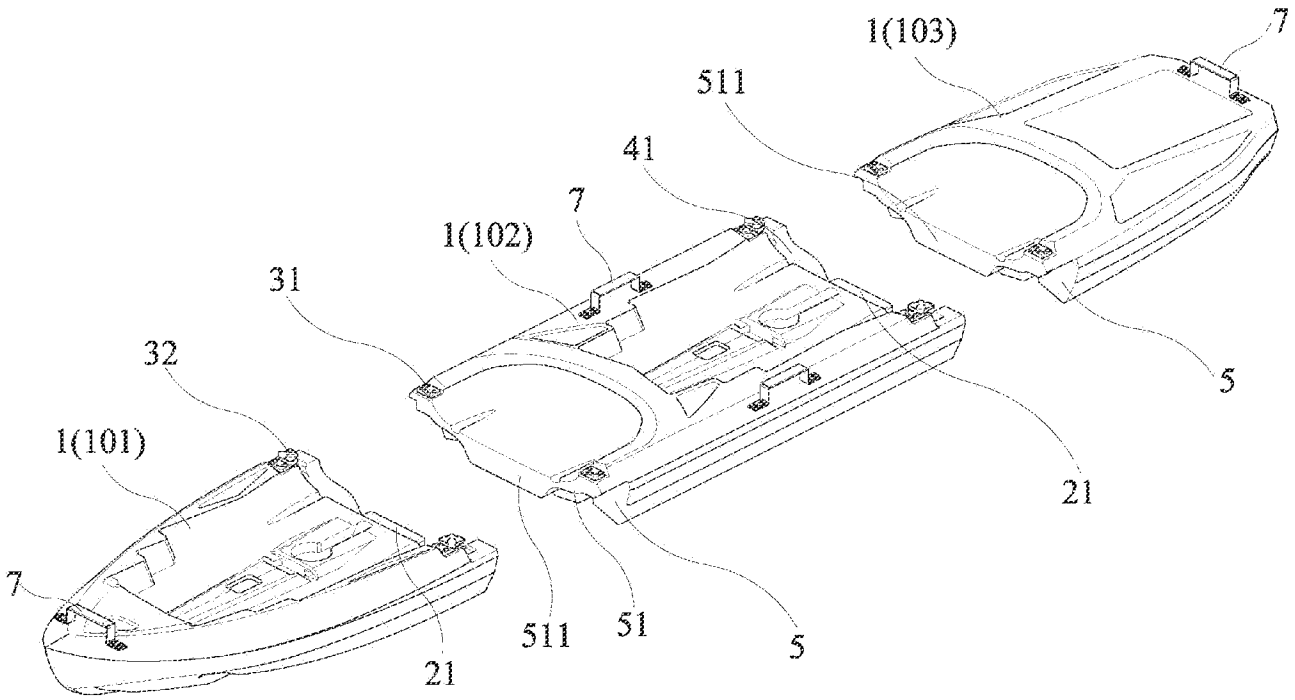
FIG. 2 is an exploded view of the present invention.
Figure 3:
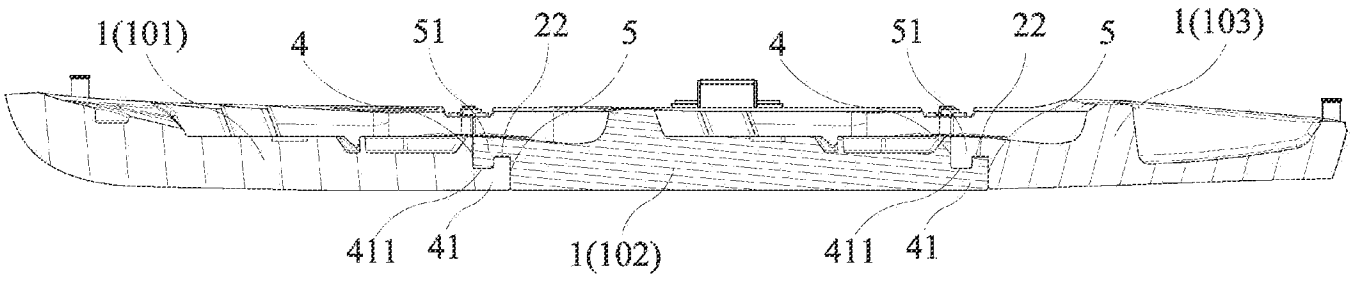
FIG. 3 is a combined sectional view 1 of the present invention.
Figure 4:
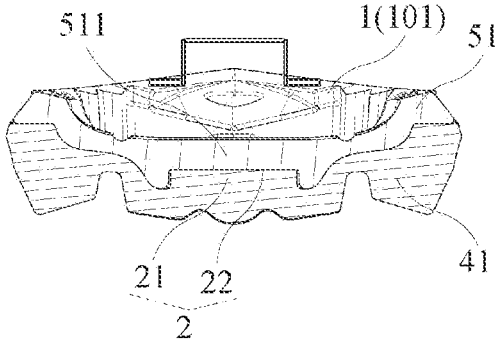
FIG. 4 is a combined sectional view 2 of the present invention.
Figure 5:
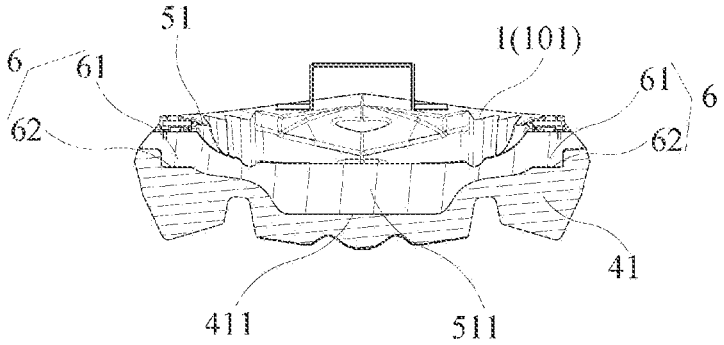
FIG. 5 is a combined sectional view 3 of the present invention.
Figure 6:
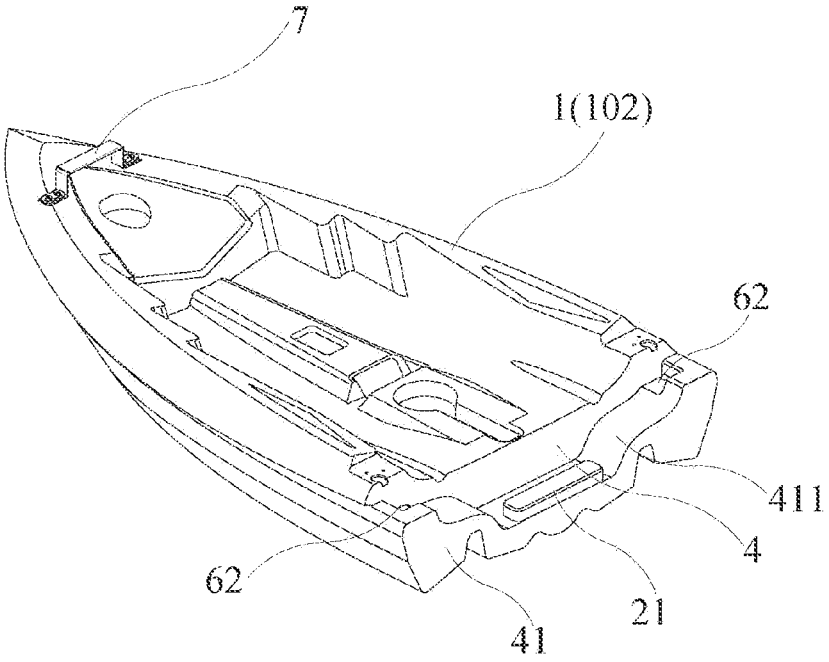
FIG. 6 is a structural view of a bow section of the present invention.
Figure 7:
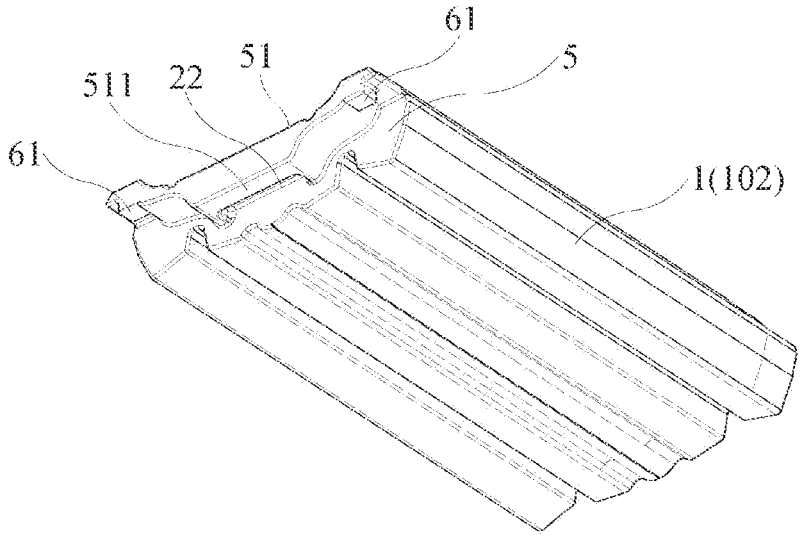
FIG. 7 is a structural view 1 of a middle hull section of the present invention.
Figure 8:
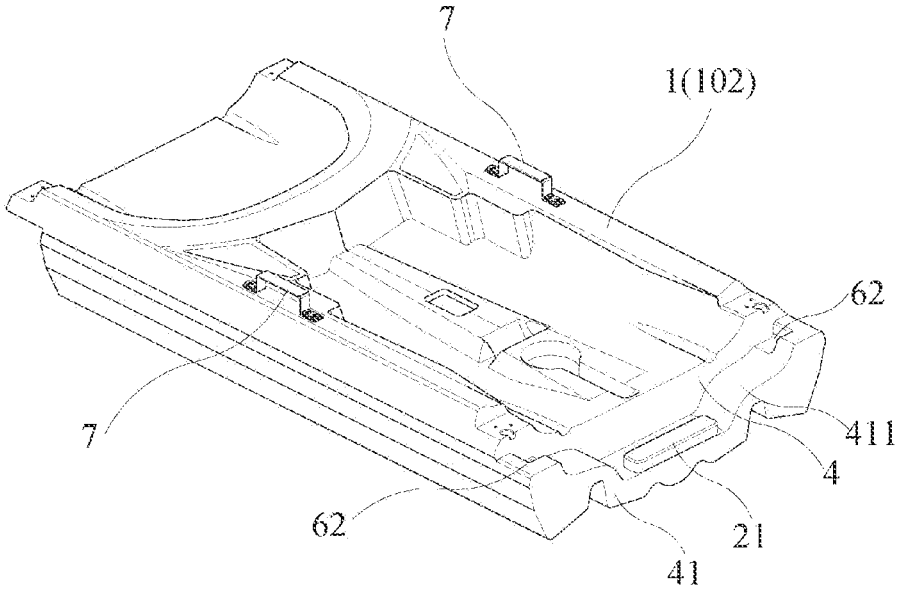
FIG. 8 is a structural view 2 of the middle hull section of the present invention.
Figure 9:
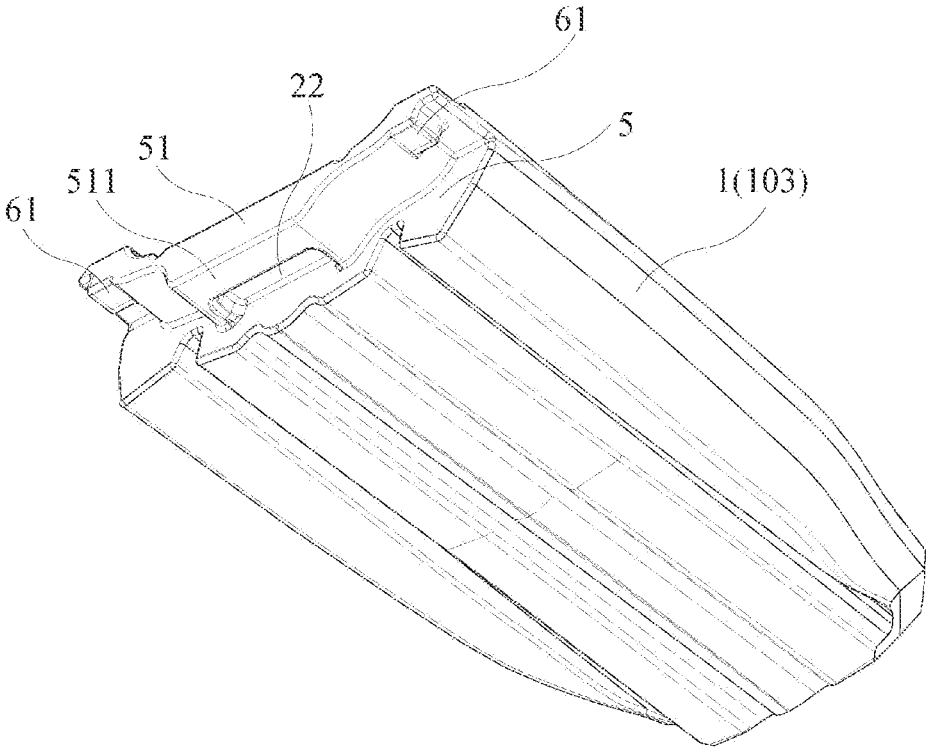
FIG. 9 is a structural view of a stern section of the present invention.

As shown in FIG. 1 and FIG. 2, the hull sections 1 may be divided into a bow section 101, a middle hull section 102, and a stern section 103. The middle hull section 102 may be connected to the bow section 101 and the stern section 103 through the splicing structure. The bow section 101 and the stern section 103 may be connected through the splicing structure. In this way, a length of the ship may be controlled by controlling a number of the middle hull section 102. The number of the middle hull section 102 may be zero.

As shown in FIGS. 1-11, the splicing structure includes a first matching structure 2 and a second matching structure 3. The first matching structure 2 includes a protrusion 21 and a groove 22 that are in a vertical inserting fit. The protrusion 21 and the groove 22 are respectively provided on two adjacent hull sections 1. The protrusion 21 is inserted into the groove 22 from bottom up to restrict the relative movement of the adjacent hull sections 1 in both axial and lateral directions of the ship. The second matching structure 3 includes a fixed base 31 and a rotating base 32 that are detachably connected to the fixed base 31. The fixed base 31 and the rotating base 32 are respectively fitted on two adjacent hull sections 1. The rotating base 32 is able to rotate. The fixed base 31 is provided with a fixed block 311. The rotating base 32 is provided thereon with a rotating block 321 that rotates to press a top surface of the fixed block 311. The rotating block 321 is clamped with the fixed block 311. After the fixed base 31 and the rotating base 32 of the second matching structure 3 are connected, the adjacent hull sections 1 are restricted from moving relative to each other in a vertical direction, thereby preventing the protrusion 21 from falling out of the groove 22. After the fixed base 31 and the rotating base 32 of the second matching structure 3 are connected, the adjacent hull sections 1 are also restricted from twisting relative to each other.

In the present invention, through the arrangement of the first matching structure 2 and the second matching structure 3 of the splicing structure, when it is necessary to connect two adjacent hull sections 1, the hull sections 1 are moved first so that the groove 22 and the protrusion 21 on the adjacent hull sections 1 are in a vertical inserting fit. Then the rotating base 31 is rotated, so that the rotating block 321 of the rotating base 32 presses against the fixed block 311 of the fixed base 31, and the rotating block 321 is engaged with the fixed block 311. In this way, the adjacent hull sections 1 are connected. This installation process is very convenient and can be operated by just one person. When there is a need to split two adjacent hull sections 1, the rotating base 32 is first rotated to separate it from the fixed base 31, then the hull sections 1 are moved so that the groove 22 and the protrusion 21 on the adjacent hull sections 1 are separated. In this way, the two adjacent hull sections 1 are separated. The entire disassembly process is similarly convenient and can also be operated by just one person. A handle 7 may be provided on the hull section 1 to enable a single user to exert force to move the hull section 1.

As shown in FIGS. 2, 3, and 6 to 9, the splicing structure further includes a first matching surface 4 and a second matching surface 5 that are respectively provided on two adjacent hull sections 1. The first matching surface 4 and the second matching surface 5 are positioned opposite from each other. The first matching surface 4 is provided thereon with a protruding first matching section 41, and the second matching surface 5 is provided thereon with a protruding second matching section 51. The protrusion 21 and the groove 22 of the first matching structure 2 are respectively provided on the first matching section 41 and the second matching section 52. After the protrusion 21 is inserted into the groove 22 from bottom up, an end surface of the first matching section 41 facing the second matching surface 5 abuts against the second matching surface 5 forming a surface-to-surface contact, and an end surface of the second matching section 51 facing the first matching surface 4 abuts against the first matching surface in a surface-to-surface contact. This configuration optimizes the restriction of the relative rotation of the adjacent hull sections 1 after a connection is formed. That is, a hull section 1 of the two adjacent hull sections 1 is restricted from rotating to the other hull section 1, thereby improving the carrying capacity of the ship. As shown in FIGS. 6 to 9, the first matching section 41 of the splicing structure is provided with a matching notch 411. An upper part of the matching notch 411 and a side part of the matching notch that faces the second matching section 51 are open. The second matching section 51 of the splicing structure is provided with a matching protrusion 511 that matches the matching notch 411. The matching protrusion 511 is placed in the matching notch 411. The protrusion 21 and the groove 22 of the first matching structure are respectively provided at the bottom of the matching notch 411 and the bottom of the matching protrusion 511. The protrusion 21 is able to protrude upward, and the groove 22 is opened downward. The arrangement of the matching notch 411 and the matching protrusion 511 facilitates the insertion of the protrusion 21 into the groove 22. The fit between the matching notch 411 and the matching protrusion 511 can also restrict the adjacent hull sections 1 to move relatively in the lateral direction of the ship. In addition, a corner of the protrusion 21 may be chamfered to facilitate the insertion of the protrusion 21 into the groove 22. Alternatively, the corner of the protrusion 21 may directly be right-angled, so that the fit between the protrusion 21 and the groove 22 is tighter and more stable. Here, it should be noted that it does not mean the protrusion 21 and the groove 22 of the first matching structure 2 are respectively provided on the first matching section 41 and the second matching section 511. Alternatively, the protrusion 21 and the groove 22 of the first matching structure 2 may be respectively provided on the second matching section 51 and the first matching section 41. In either case, the protrusion 21 and the groove 22 are able to form a vertical inserting fit.

As shown in FIGS. 1, 2, 10 and 11, the second matching structure 3 further includes a connecting base 33 rotatably connected with the rotating base 32. The fixed base 31 and the connecting base 33 of the second matching structure 3 are respectively fixed on two adjacent hull sections 1 by means of screw locking. In this way, the fixed base 31 and the rotating base 32 are respectively fitted on the two adjacent hull sections 1. A side wall of the fixed block 311 of the second fixed base 31 is provided with an arc-shaped connecting surface 3111. The arc-shaped connecting surface 3111 is provided with external teeth 3112. The rotating block 321 is provided with an arc-shaped elastic piece 3211. An inner side of the arc-shaped elastic piece 3211 is provided with internal teeth 3212 engaged with the external teeth 3112, so that the rotating block 321 is clamped with the fixed block 311. By rotating the rotating block 321, it can control the internal teeth 3212 to engage with the external teeth 3112 of the fixed block 311. A top surface of the rotating block 321 may be provided with a shifting block 322 for a person to exert force to rotate the rotating block 321. It should be noted that the fixed base 31 and the connecting base 33 of the second matching structure 3 are not limited to be fixed on two adjacent hull sections 1 respectively by means of screw locking. Instead, the fixed base 31 and the connecting base 33 of the second matching structure 3 may also be fixed on two adjacent hull sections 1 respectively by welding or integral molding.

Figure 10:
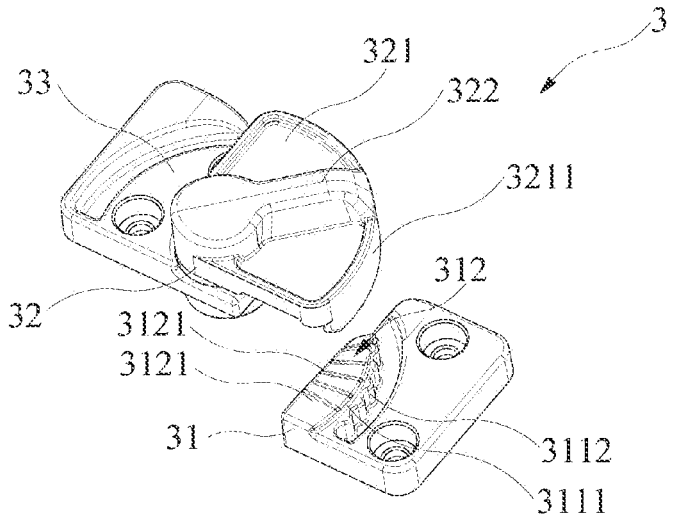
FIG. 10 is a partial exploded view 1 of a third matching structure of the present invention.
Figure 11:
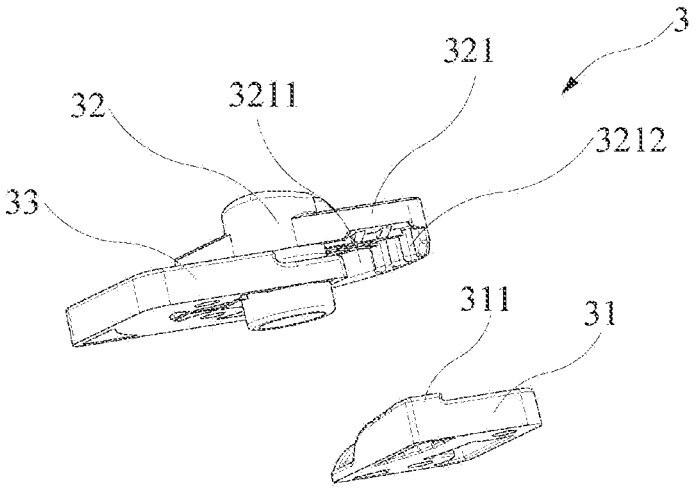
FIG. 11 is a partial exploded view 2 of the third matching structure of the present invention.

As shown in FIG. 10 and FIG. 11, the top surface of the fixed block 311 of the second matching structure 3 may be provided with a multi-step ladder 312. The multi-step ladder 312 includes multiple steps 3121 in an ascending order of height. The height of the steps 3121 may be sequentially increased along a circumferential direction of the arc-shaped connecting surface 3111. The rotating block 321 of the rotating base 32 rotates to press one step 3121 of the multi-step ladder 312. By pressing the steps 3121 of different heights by the rotating block 321, downward forces of different magnitudes are exerted to the fixed block 311. A greater downward force exerted by the rotating block 321 on the fixed block 311 makes it better to restrict the adjacent hull sections 1 from moving relative to each other in the vertical direction and to restrict the adjacent hull sections 1 from twisting relative to each other. It should be noted that the top surface of the fixed block 311 of the second matching structure 3 may be an inclined wedge surface. A height of the wedge surface may increase in the circumferential direction of the arc-shaped connecting surface 3111. The rotating block 321 of the rotating base 32 is provided with an inclined surface configured to rotate and to press against the wedge surface. The magnitude of the downward force exerted by the rotating block 321 on the fixed block 311 may also be controlled by the cooperation of the inclined surface and the wedge surface.

As shown in FIG. 1, there are two second matching structures 3 of the splicing structure, and the two second matching structures 3 of the splicing structure are respectively located on both sides of the ship. In this way, the relative movement of adjacent hull sections 1 in the vertical direction and the relative twisting of the adjacent hull sections 1 can be better restricted. It should be noted that there is at least one second matching structure 3 of the splicing structure in the present invention. A single second matching structure 3 is sufficient to restrict the relative movement of the adjacent hull sections 1 in the vertical direction and to restrict the relative twisting of the adjacent hull sections 1. A larger number of the second matching structures 3 of the splicing structure makes it better to restrict the relative movement of the adjacent hull sections 1 in the vertical direction and to restrict the relative twisting of the adjacent hull sections 1.

As shown in FIGS. 5-9, the splicing structure further includes a third matching structure 6. The third matching structure 6 includes an insert block 61 and a slot 62 that are in a vertical inserting fit. The insert block 61 and the slot 62 are respectively provided on two adjacent hull sections 1. The slot 62 and the insert block 61 of the third matching structure 6 are respectively located on the first matching section 41 and the second matching section 51 of the splicing structure. In the present invention, while the protrusion 21 and the groove 22 of the first matching structure 2 are in a vertical inserting fit, the insert block 61 and the slot 62 of the third matching structure 6 are also in a vertical inserting fit. The first matching structure 2 and the third matching structure 6 of the splicing structure are staggered along the axial direction of the ship. In this way, two limiting parts separated in the axial direction of the ship of the present invention are formed, which makes the connection of adjacent hull sections 1 more stable, so that each hull section 1 after the connection is able to withstand a greater axial force and lateral force. The first matching structure 2 and the third matching structure 6 of the splicing structure may also be staggered in the vertical direction, which makes the connection of adjacent hull sections 1 more stable. There are two third matching structures 6 of the splicing structure. The slots 62 of the two third matching structures 6 of the splicing structure may be respectively provided on both sides of the first matching section 41, and the insert blocks 61 of the two third matching structures 6 of the splicing structure are respectively provided on both sides of the second matching section 51. The insert block 61 protrudes downward, and the slot 62 is opened at the top. In addition, a corner of the insert block 61 of the third matching structure 6 may be chamfered to facilitate the insertion of the insert block 61 into the insert block 61. Alternatively, the corner of the insert block 61 may directly be right-angled, so that the fit between the insert block 61 and the insert block 61 is tighter and more stable.

As shown in FIGS. 5-9, a protruding direction of the protrusion 21 of the first matching structure 2 of the splicing structure is opposite to the protruding direction of the insert block 61 of the third matching structure 6. In this way, the first matching structure 2 and the third matching structure 6 are able to form an interlocking fit, so that two adjacent hull sections 1 can be connected more firmly.

The above examples and drawings are not intended to limit the form and style of the product of the present invention. Any appropriate changes or modifications to the present invention made by those of ordinary skill in the art should be regarded as not departing from the patent scope of the present invention.

What is claimed is:

1. A ship comprising at least two adjacent hull sections spliced together along an axial direction of the ship, wherein the at least two adjacent hull sections are connected through a splicing structure; wherein the splicing structure comprises a first matching structure and a second matching structure;

the first matching structure comprises a protrusion and a groove that are in a vertical inserting fit; the protrusion and the groove are respectively provided on the at least two adjacent hull sections;

the second matching structure comprises a fixed base and a rotating base, wherein the fixed base and the rotating base are detachably connected to the fixed base and fitted on the at least two adjacent hull sections, respectively; wherein the rotating base is configured to rotate; wherein the fixed base is provided with a fixed block; wherein the rotating base is provided thereon with a rotating block that rotates to press against a top surface of the fixed block; wherein the rotating block is clamped with the fixed block.

2. The ship according to claim 1, wherein a side wall of the fixed block of the fixed base is provided with an arc-shaped connecting surface; wherein the arc-shaped connecting surface is provided with external teeth; wherein the rotating block is provided with an arc-shaped elastic piece; wherein an inner side of the arc-shaped elastic piece is provided with internal teeth engaged with the external teeth.

3. The ship according to claim 1, wherein the top surface of the fixed block is provided with a multi-step ladder; wherein the multi-step ladder comprises multiple steps in an ascending order of height; wherein the rotating block of the rotating base rotates to press a step.

4. The ship according to claim 1, wherein the top surface of the fixed block is provided with an inclined wedge surface; wherein the rotating block of the rotating base is provided with an inclined surface for rotating to press the inclined wedge surface.

5. The ship according to claim 1, wherein the second matching structure further comprises a connecting base rotatably connected with the rotating base; wherein the fixed base and the connecting base of the second matching structure are respectively fixed on the at least two adjacent hull sections.

6. The ship according to claim 1, wherein there are two second matching structures of the splicing structure, and the two second matching structures of the splicing structure are respectively located on both sides of the ship.

7. The ship according to claim 1, wherein the splicing structure further comprises a third matching structure, wherein the third matching structure comprises an insert block and a slot that are in a vertical inserting fit; the insert block and the slot are respectively provided on the at least two adjacent hull sections; the first matching structure and the third matching structure of the splicing structure are staggered along the axial direction of the ship.

8. The ship according to claim 7, wherein the first matching structure and the third matching structure of the splicing structure are staggered in a vertical direction; a corner of the insert block of the third matching structure is chamfered or right-angled.

9. The ship according to claim 7, wherein a protruding direction of the protrusion of the first matching structure of the splicing structure is opposite to a protruding direction of the insert block of the third matching structure.

10. The ship according to claim 1, wherein the splicing structure further comprises a first matching surface and a second matching surface, wherein the first matching surface and the second matching surface are provided on the at least two adjacent hull sections, respectively; the first matching surface and the second matching surface are opposite to each other; the first matching surface is provided thereon with a protruding first matching section, and the second matching surface is provided thereon with a protruding second matching section; an end surface of the first matching section facing the second matching surface abuts against the second matching surface in a surface-to-surface contact, and an end surface of the second matching section facing the first matching surface abuts against the first matching surface forming a surface-to-surface contact;

the protrusion and the groove of the first matching structure are respectively provided on the first matching section and the second matching section; alternatively, the protrusion and the groove of the first matching structure are respectively provided on the second matching section and the first matching section.

11. The ship according to claim 10, wherein the first matching section of the splicing structure is provided with a matching notch; an upper part of the matching notch and a side part of the matching notch that faces the second matching section are opened; the second matching section of the splicing structure is provided with a matching protrusion that matches the matching notch and is placed in the matching notch;

the protrusion and the groove of the first matching structure are respectively provided at the bottom of the matching notch and the bottom of the matching protrusion; the protrusion protrudes upward, and the groove is opened downward; a corner of the protrusion of the first matching structure is chamfered or right-angled.

12. The ship according to claim 1, wherein a handle is provided on the hull section.

13. The ship according to claim 2, wherein the top surface of the fixed block is provided with a multi-step ladder; wherein the multi-step ladder comprises multiple steps in an ascending order of height; wherein the rotating block of the rotating base rotates to press a step.

14. The ship according to claim 2, wherein the top surface of the fixed block is provided with an inclined wedge surface; wherein the rotating block of the rotating base is provided with an inclined surface for rotating to press the inclined wedge surface.

15. The ship according to claim 2, wherein the second matching structure further comprises a connecting base rotatably connected with the rotating base; wherein the fixed base and the connecting base of the second matching structure are respectively fixed on the at least two adjacent hull sections.

16. The ship according to claim 2, wherein there are two second matching structures of the splicing structure, and the two second matching structures of the splicing structure are respectively located on both sides of the ship.

17. The ship according to claim 8, wherein a protruding direction of the protrusion of the first matching structure of the splicing structure is opposite to a protruding direction of the insert block of the third matching structure.

* * * * *